US005611427A

United States Patent [19]

Bigham

[11] Patent Number: 5,611,427

[45] Date of Patent: Mar. 18, 1997

[54] CARRIER FOR IN-LINE SKATES AND ICE SKATES

[76] Inventor: David W. Bigham, 3906 Willmatt Hill, Minnetonka, Minn. 55305

[21] Appl. No.: 589,412

[22] Filed: Jan. 22, 1996

[51] Int. Cl.[6] ..... B65D 71/00; B65D 63/18

[52] U.S. Cl. ..... 206/315.1; 206/523; 206/579; 224/917; 294/154; 383/38

[58] Field of Search ..... 206/315.1, 523, 206/579; 224/917; 294/149, 150, 154, 157, 159; 383/38

[56] References Cited

U.S. PATENT DOCUMENTS

| | | | |
|---|---|---|---|
| 2,672,263 | 3/1954 | Alber | 206/315.1 |
| 3,209,870 | 10/1965 | Johns | 206/315.1 |
| 3,368,655 | 2/1968 | Purdy | 206/315.1 |
| 3,399,750 | 9/1968 | Woolworth | 206/315.1 |
| 4,021,054 | 5/1977 | Csutor | 206/315.1 |
| 4,126,256 | 11/1978 | McGruder | 383/38 |
| 5,456,353 | 10/1995 | Challloner et al. | 206/315.1 |

*Primary Examiner*—Paul T. Sewell
*Assistant Examiner*—Luan Z. Bui
*Attorney, Agent, or Firm*—Merchant, Gould, Smith, Edell, Welter & Schmidt, P.A.

[57] ABSTRACT

The present invention is directed to an apparatus for carrying in-line skates. The in-line skates have blades that include at least two adjacent wheels. The apparatus comprises a base member having a front, back and bottom. The base member defines first and second slots, each open to the bottom and extending from the front to the back. The first and second slots are each sized to receive the blade of an in-line skate so that the base member is substantially perpendicular to the in-line skate blades.

14 Claims, 1 Drawing Sheet

CARRIER FOR IN-LINE SKATES AND ICE SKATES

TECHNICAL FIELD

The present invention relates to an apparatus for carrying skates, and more particularly to an apparatus for carrying in-line skates.

BACKGROUND

In-line skating has become a very popular sport. People of all ages use in-line skates for leisure, exercise and competitive sports such as hockey. However, avid in-line skaters do not usually use their skates at home. Rather, they typically carry them to a park that has appropriate conditions such as asphalt paths. The difficulty is that in-line skates are bulky and difficult to handle when not skating.

Some people even use in-line skates as a combined form of exercise and transportation around the city—much like a bicycle. However, many stores, restaurants, and other business do not allow people to wear in-line skates on their premises. As a result, people must carry their shoes while they are skating, which can be burdensome.

Furthermore, people that are avid in-line skaters also tend to have an interest in ice skating. For example, many children that play ice hockey in the winter might also play street hockey with in-line skates in the summer. Ice skates are also difficult to handle when carrying them to an ice-skating rink.

People have designed various types carriers in an effort to make carrying in-line or ice skates more manageable. For example, one device for carrying in-line skates has a pair of channel irons sized to receive the entire length of the in-line skate blade. A handle is attached to the channel irons and extends upward. The handle is taller than the combined height of the boot and the blade.

The difficulty with such a device is that it is bulky and difficult to store. Additionally, such a bulky device cannot be carried with the person while they are skating. As a result, it must be left attended and is easily stolen. Another shortcoming is that such a device is adaptable to carry ice skates. Thus, an avid skater would need two carriers, one for ice-skates and one for in-line skates.

Other people have designed boot carriers. However, many of these boot carriers have a flat surface on which the sole of the boot can rest. Such a carrier is not configured to securely hold a boot that has a blade such as in-line skates or ice skates. Other boot carriers are merely composed from straps that can be difficult to put on the boots. Furthermore, such straps can become easily tangled.

There are also carriers that are configured to carry ice skates. However, ice-skate carriers are typically long and define slots that receive the entire length of the skate blade.

Such ice-skate carriers are not appropriate for in-line skates. The reason is that blades for in-line skates are large and bulky. A corresponding carrier that is configured to receive the length of an in-line skate blade also would be large and bulky. Such a carrier would be heavy, difficult to manage, and defeat the purpose of having a carrier. Also, such slots would be so large that they could not also accommodate ice-skate blades. Again, an avid skater would require two carriers, one for their ice skates and one for their in-line skates.

Therefore, there is a need in the art for a carrier that has slots sized to receive in-line skate blades, but is still lightweight, compact, and easy to carry. There is a further need in the art for an in-line skate carrier that a person can easily carry while they are skating. Such a carrier might also allow a person to carry their street shoes while they are skating. There is a further need in the art for a carrier that is versatile and allows a person to carry either in-line skates or ice skates.

SUMMARY

The present invention is directed to an apparatus for carrying in-line skates. The in-line skates have blades that include at least two adjacent wheels. The apparatus includes a base member having a front, back, and bottom. The base member defines first and second slots, each open to the bottom and extending from the front to the back. The first and second slots are each sized to receive the blade of an in-line skate so that the base member is substantially perpendicular to the in-line skate blades. First and second straps are operably connected to the base member. The first strap is configured to extend across the first slot and secure an in-line skate blade into the first slot. The second strap is configured to extend across the second slot and secure an in-line skate blade into the second slot.

DETAILED DESCRIPTION

Figure 2:
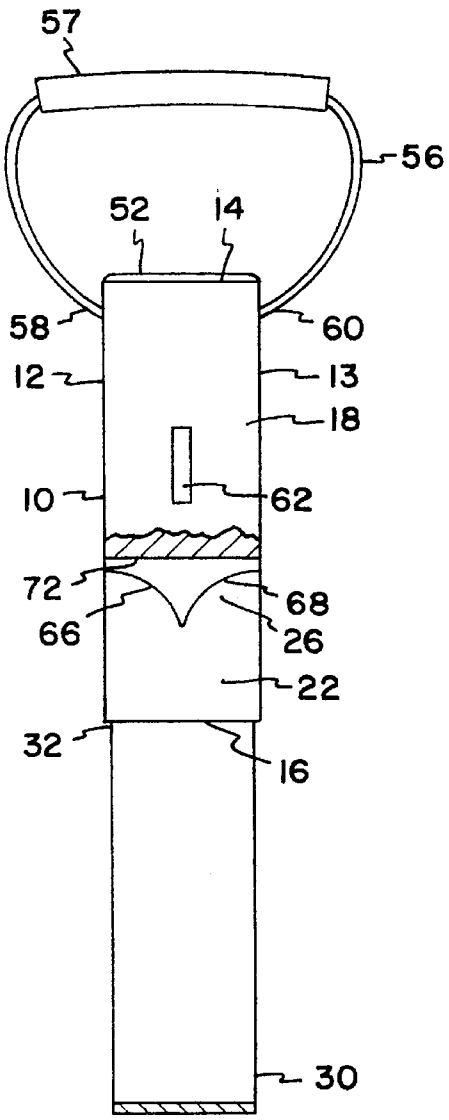
FIG. 2 is a side elevational view of the present invention shown in FIG. 1 with a breakout showing the V-shaped inner surface of a slot sized to receive an in-line skate blade.

A preferred embodiment of the present invention will be described in detail with reference to the drawing, wherein like reference numerals represent like parts and assemblies throughout the several views. Reference to the preferred embodiment does not limit the scope of the invention, which is limited only by the scope of the claims attached hereto.

Figure 1:
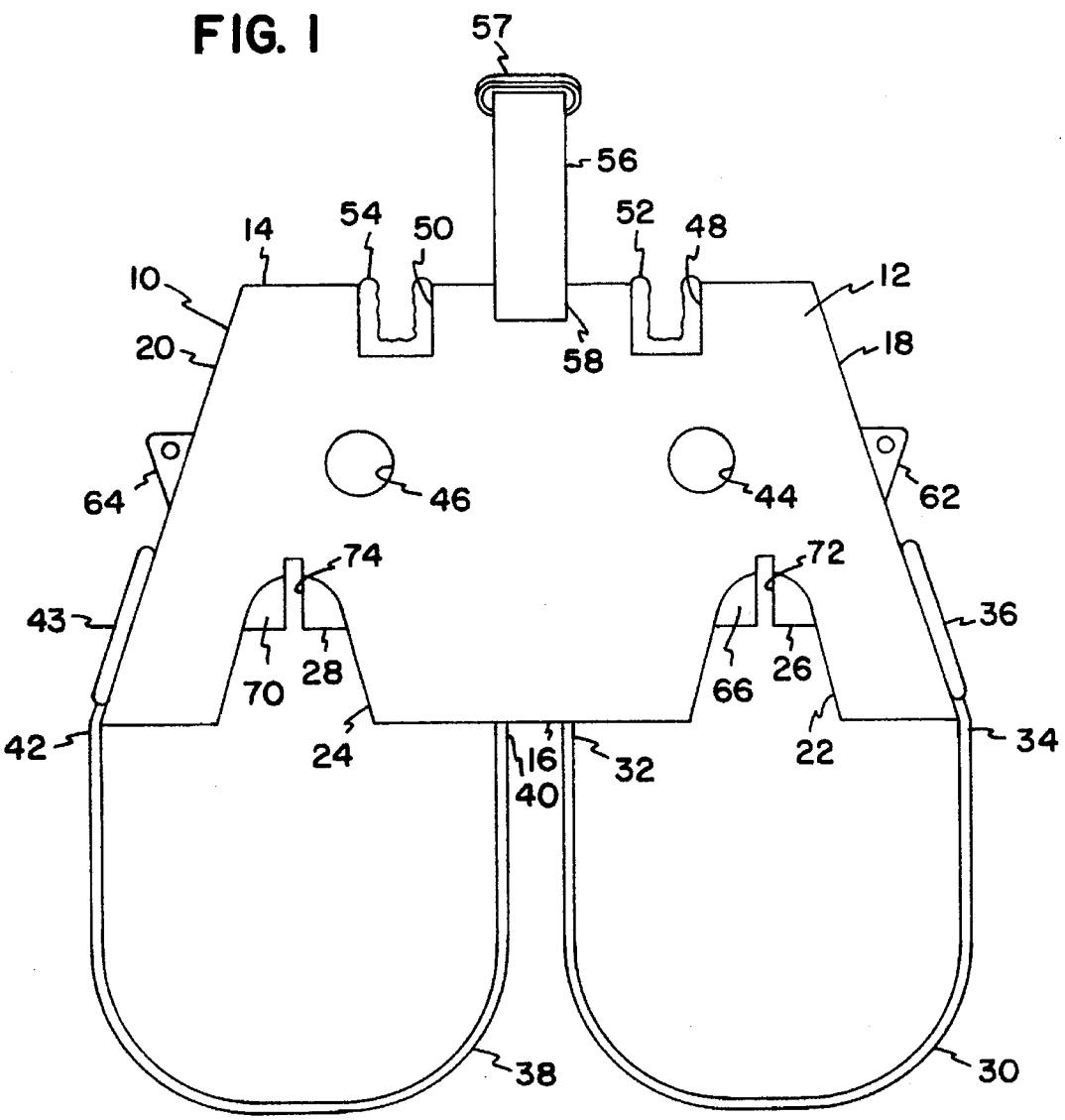
FIG. 1 is front elevational view of the present invention.

Referring to FIGS. 1 and 2, the present invention includes a base member 10 having a front 12, rear 13, bottom 14, top 16, and oppositely disposed sides 18 and 20. First and second slots 22 and 24 are defined in base number 10 and are open to bottom 16. Additionally, the first and second slots 22 and 24 each extend from the front 12 to the rear 13 of the base member 10. The base member 10 can be made from a variety of materials including a durable, light-weight plastic.

The base member 10 has first and second inner surfaces 26 and 28 that form the upper portion of the first and second slots 22 and 24, respectively. The first inner surface 26 is configured to fit between adjacent wheels on an in-line skate blade. In particular, first inner surface 26 is V-shaped so that it has first and second angled portions 66 and 68. Each angled portion 66 and 68 is concave so that the angled portions 66 and 68 conform to the curvature of adjacent in-line skate wheels.

Second inner surface 28 is substantially similar to first inner surface 26 and is V-shaped thereby defining third and fourth angle portions 70 and (not shown). Third and fourth angled portions 70 and (not shown) are concave and conform to the shape of the adjacent in-line skate wheels.

Additionally, base member 10 defines a first inner slot 72 that extends from the front 12 to the rear 13 and is open to the first inner surface 26. First inner slot 72 is sized to receive the blade of an ice skate. Similarly, base member 10 defines a second inner slot 74 that extends from the front 12 to the rear 13 and is open to the second inner surface 28. Second inner slot 74 is also sized to receive the blade of an ice skate.

In an alternative embodiment, first inner or ice-skate slot 72 can be positioned next to first slot 22 and open to bottom 16 rather than first inner surface 26. Similarly, second inner or ice-skate slot 74 can be positioned next to second slot 24 and open to bottom 16 rather than second inner surface 28.

A first strap 30 has a first end portion 32 and a second, oppositely-disposed end portion 34. A first buckle 36 is mounted on the side of base member 10. The first end portion 32 is operably connected to the bottom 16 of base member 10 at a position between first and second slots 22 and 24. The second end portion 34 is operably connected to the first buckle 36.

A second strap 38 has a first end portion 40 and a second, oppositely-disposed end portion 42. A second buckle 43 is mounted on the side 20 of base member 10. The first end portion 40 is operably connected to the bottom 16 of base member 10 at a position between first and second slots 22 and 24. The second end portion 42 is operably connected to the second buckle 43.

One skilled in the art will appreciate that a variety of means can be used to fasten the first and second straps 30 and 38 to the base member 10. For example, buckles can be used as described above. There are a variety of different types of buckles that can be used. For example, some buckles will allow the straps to be removed from the buckle. Other buckles will allow the strap to loosen, but not be released. Additionally, other types of fasteners can be used in lieu of buckles. Velcro brand fasteners are an example of an alternative fastener.

In order to use base member 10 to carry in-line skates, the user can insert an in-line skate blade from one skate into first slot 22 so that first inner surface 26 is positioned between adjacent wheels. The user can then position first strap 30 around the boot and connect second end portion 34 of first strap 30 to first buckle 36, thereby securing the in-line skate to base number 10. The other skate from the pair is similarly attached to base member 10 by positioning the in-line skate blade into second slot 24, extending second strap 38 around the skate boot, and connecting the second end portion 42 to the second buckle 43.

In this position, base member 10 is positioned perpendicular to the blades of the in-line skates. Additionally, first and second inner surfaces 26 and 28 prevent base member 10 from sliding along the length of the in-line skate blades.

Ice skates are connected to the base member in a substantially similar manner. The primary difference is that the ice skate blades are placed in the first and second inner slots 72 and 74.

The present invention has many advantages. For example, because the slots are oriented so that the base unit is positioned perpendicular to the blades, the carrier needs to be made from only a minimal amount of material. As a result, it is light weight and compact. As a result a person can easily carry the base member 10 while skating, can easily throw the carrier and skates into a duffel bag with other equipment such as hockey gear, and can easily store the carrier when not is use.

In addition to being light-weight and compact, the carrier is advantageous because it securely holds the skates together and keeps them from twisting relative to one another. As a result, skates are much easier to carry.

Having one set of slots sized for ice skates and another set of slots sized for in-line skates is also advantageous. Such an embodiment makes the carrier versatile so that it can be used all year long. Furthermore, there is added versatility because the same strap can be used to secure the skate boot regardless of the whether it is an ice skate or an in-line skate. This versatility results from the close proximity of the slots for receiving in-line skate blades and the slots for receiving ice-skate blades.

Additionally, first and second hockey-stick slots 48 and 50 are defined in base member 10 and extend from the front 12 to the rear 13. The first and second hockey-stick slots 48 and 50 can be positioned so that they are open to top 14. Additionally, first and second liners 52 and 54 are positioned within first and second hockey-stick slots 48 and 50, respectively. The first and second hockey-stick slots 48 and 50 are sized to receive a hockey-stick handle. The first and second liners 52 and 54 are made from a compliant material such as rubber that will conform to the shape and size of the hockey-stick handle. Thus, the first and second liners will help to secure the hockey stick handles in the first and second hockey-stick slots 48 and 50. One advantage of this embodiment is that both skates and hockey sticks can be carried in one hand.

A strap handle 56 is operably connected to the base member 10 and has a first end 58 operably connected to the front 12 and a second end 60 operably connected to the rear 13. A pad 57 is wrapped around the strap handle 56. One skilled in the art will realize that other types of handles, such as plastic handles, can be used in place of strap handle 56. Additionally, a first flange 62 is operably connected to the side 18 of base member 10. A second flange 64 is operably connected to the oppositely-disposed side 20 of base member 10. A person can attach either a shoulder strap (not shown) or a waist strap (not shown) to the first and second flanges 62 and 64.

A waist strap is useful when the person is skating. They could easily carry base member 10 with them much like a fanny pack. Additionally, the base member 10 defines first and second holes 44 and 46. A person could attach their street shoes to base member 10 by tieing the shoe laces through first and second holes 44 and 46. Using the base member 10 in this manner is advantageous because the person can carry their street shoes with them while they are skating and can easily change between street shoes and in-line skates in case they stop and have to walk into a store, restaurant, concessions booth, or other business establishment. Additionally, the user does not have to leave their street shoes unattended while they are skating.

While the invention has been described in conjunction with a specific embodiment thereof, it is evident that different alternatives, modifications, and variations will be apparent to those in the art in view of the foregoing description. Accordingly, the invention is not limited to these embodiments or the use of elements having specific configurations and shapes as presented herein.

The claimed invention is:

1. An apparatus for carrying in-line skates, the in-line skates having blades, the blades including at least two adjacent wheels, the apparatus comprising:

a base member having a front, back, and bottom, the base member defining first and second slots each open to the bottom and extending from the front to the back, the first and second slots each being sized to receive the blade of an in-line skate so that the base member is substantially perpendicular to the in-line skate blades; and first and second straps operably connected to the base member, the first strap being configured to extend across the first slot and secure an in-line skate blade into the first slot, the second strap being configured to extend across the second slot and secure an in-line skate blade into the second slot.

2. The apparatus of claim 1 wherein the first and second slots each have an upper surface, each upper surface being configured to fit between adjacent wheels that form a part of the in-line skate blade.

3. The apparatus of claim 2 wherein the base member further defines first and second inner slots configured to receive ice skate blades, the first inner slot being open to the upper surface of the first slot and extending from the front of the base member to the back of the base member, the second inner slot being open to the upper surface of the second slot and extending from the front of the base member to the back of the base member.

4. The apparatus of claim 1 wherein the base member defines first and second hockey-stick slots, the first and second hockey-stick slots each being sized to receive the handle of a hockey stick, the first and second hockey-stick slots each extending from the front to the back of the base member.

5. The apparatus of claim 4 further comprising first and second linings positioned within the first and second hockey-stick slots, respectively, the first and second linings being configured to secure a hockey-stick handle in the first and second hockey-stick slots, respectively.

6. The apparatus of claim 1 wherein the base member further defines an opening, the opening being configured to receive shoe laces.

7. The apparatus of claim 1 wherein the base member further defines first and second openings, the first and second openings each being configured to receive shoe laces.

8. The apparatus of claim 1 further comprising a carrying strap operably connected to the base member.

9. The apparatus of claim 8 wherein the carrying strap is a shoulder strap.

10. The apparatus of claim 8 wherein the carrying strap is a waste strap.

11. An apparatus for carrying in-line skates, the in-line skates having blades, the blades including at least two adjacent wheels, the apparatus comprising:

a base member having a front, back, and bottom, the base member defining:

first and second slots each open to the bottom and extending from the front to the back, the first and second slots each being sized to receive the blade of an in-line skate so that the base member is substantially perpendicular to the in-line skate blades; and first and second inner slots configured to receive ice skate blades, the first inner slot being open to the upper surface of the first slot and extending from the front of the base member to the back of the base member, the second inner slot being open to the upper surface of the second slot and extending from the front of the base member to the back of the base member; and first and second straps operably connected to the base member, the first strap being configured to extend across the first slot and secure an in-line skate blade into the first slot, the second strap being configured to extend across the second slot and secure an in-line skate blade into the second slot.

12. The apparatus of claim 11 wherein the first and second slots each have an upper surface, each upper surface being configured to fit between adjacent wheels that form a part of the in-line skate blade.

13. The apparatus of claim 12 wherein the base member defines first and second hockey-stick slots, the first and second hockey-stick slots each being sized to receive the handle of a hockey stick, the first and second hockey-stick slots each extending from the front to the back of the base member.

14. An apparatus for carrying in-line skates, the in-line skates having blades, the blades including at least two adjacent wheels, the apparatus comprising:

a base member having a front, back, and bottom, the base member defining:

first and second slots each open to the bottom and extending from the front to the back, the first and second slots each being sized to receive the blade of an in-line skate so that the base member is substantially perpendicular to the in-line skate blades, the first and second slots each having an upper surface, each upper surface being configured to fit between adjacent wheels that form a part of the in-line skate blade;

first and second inner slots configured to receive ice skate blades, the first inner slot being open to the upper surface of the first slot and extending from the front of the base member to the back of the base member, the second inner slot being open to the upper surface of the second slot and extending from the front of the base member to the back of the base member; and first and second hockey-stick slots, the first and second hockey-stick slots each being sized to receive the handle of a hockey stick, the first and second hockey-stick slots each extending from the front to the back of the base member; and first and second straps operably connected to the base member, the first strap being configured to extend across the first slot and secure an in-line skate blade into the first slot, the second strap being configured to extend across the second slot and secure an in-line skate blade into the second slot.

* * * * *